US008864917B2

(12) United States Patent
Thete

(10) Patent No.: US 8,864,917 B2
(45) Date of Patent: Oct. 21, 2014

(54) GROUP 5 METAL SOURCE CARBIDE COATED STEEL ARTICLE AND METHOD FOR MAKING SAME

(75) Inventor: Manoj Thete, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 458 days.

(21) Appl. No.: 13/123,731

(22) PCT Filed: Oct. 7, 2009

(86) PCT No.: PCT/US2009/059781

§ 371 (c)(1),
(2), (4) Date: Apr. 12, 2011

(87) PCT Pub. No.: WO2010/045076

PCT Pub. Date: Apr. 22, 2010

(65) Prior Publication Data

US 2011/0192499 A1 Aug. 11, 2011

Related U.S. Application Data

(60) Provisional application No. 61/105,898, filed on Oct. 16, 2008.

(51) Int. Cl.
*C23C 8/66* (2006.01)

(52) U.S. Cl.
USPC .... 148/278; 148/319; 427/249.1; 427/249.17

(58) Field of Classification Search
USPC ..... 148/278, 319; 427/249.1, 249.17
See application file for complete search history.

(56) References Cited

U.S. PATENT DOCUMENTS

| | | | | |
|---|---|---|---|---|
| 2,685,545 | A | 8/1954 | Sindeband | |
| 3,874,909 | A | 4/1975 | Arai et al. | |
| 4,786,526 | A * | 11/1988 | Arai et al. | 427/249.17 |
| 4,844,949 | A * | 7/1989 | Arai et al. | 427/213 |

FOREIGN PATENT DOCUMENTS

| | | | |
|---|---|---|---|
| EP | 0252480 | A2 | 1/1988 |
| EP | 1635087 | A1 | 3/2006 |
| JP | S61199066 | A | 9/1986 |
| JP | S6447844 | A | 2/1989 |
| JP | H03202459 | A | 9/1991 |
| JP | 2004360755 | A | 12/2004 |
| JP | 2008025622 | A | 2/2008 |
| WO | 0202843 | A2 | 1/2002 |

OTHER PUBLICATIONS

Japanese Office Action dated Dec. 13, 2013; Applicant: BorgWarner Inc.; Application No. 2011-532148; 6 pages.

Saduman Sen et al. "Sliding wear behavior of niobium carbide coated AISI 1040 steel", WEAR, vol. 264, No. 3-4 , May 15, 2007, pp. 219-225, XP022361285, Elsevier Sequoia Lausanne [Ch], ISSN: 0043-1648, DOI: 10.1016/J. WEAR.2007.03.006.

European Search Report dated Jun. 26, 2014; Application No. 09821031.3-1362/2350335 PCT/US 2009059781; Applicant: BorgWarner Inc.; 7 pages.

* cited by examiner

*Primary Examiner* — Lois Zheng
(74) *Attorney, Agent, or Firm* — BrooksGroup

(57) ABSTRACT

One exemplary embodiment includes a process for forming a hard carbide coating onto a low chromium-containing steel article via a chemical deposition process carried out on a particulate mix, in which molybdenum in the form of a compound FeMo or titanium in the form of a compound FeTi, or a mixture of FeMo and FeTi, may be added to the particulate mix used to form the coating.

5 Claims, 2 Drawing Sheets

GROUP 5 METAL SOURCE CARBIDE COATED STEEL ARTICLE AND METHOD FOR MAKING SAME

This application claims the benefit of U.S. Provisional Application Ser. No. 61/105,898 filed Oct. 16, 2008 and PCT Application Serial No. US09/59781 filed Oct. 7, 2009.

TECHNICAL FIELD

The field to which the disclosure relates generally to wear resistant steel articles and, in particular, to a process for increasing adhesion of a Group 5 metal source carbide coating to a low chromium containing steel substrate to form a wear resistant steel article.

BACKGROUND

Power transmission chains are widely used in the automotive industry not only for ignition timing, but also for transferring mechanical power to the driving wheels of a vehicle. Two types of power transmission chains are traditional roller chains and the so-called "silent chains". Both roller chains and silent chains use steel pins as important components.

During assembly and subsequent operation of a vehicle, the steel pins are subject to wear. To improve the wear resistant properties of the steel substrates, a hard coating may be applied to the steel substrate. For example, vanadium carbide (VC) coatings have been placed on small steel parts such as pins to improve wear resistance. The composition of the pin substrate steel, however, may have a significant effect on vanadium coated steel pins. For example, steel substrate materials having about 1.5 weight percent or less of chromium is thought to not form enough diffusion of carbide at the vanadium carbide coating/steel interface, which may result in poor adhesion of the vanadium carbide coating to the steel substrate.

It has been found that appropriate carbon content of the substrate steel can ensure the thickness of the VC coating and impart strength and hardness, and appropriate chromium content in the substrate steel is important for good adhesion of the coating to the substrate steel pins.

As a solution, pins having a hard chromium carbide layer can be made by depositing the chromium from FeCr powder surround the pin surface at 970 degrees Celsius. However, the use of ferro-chromium and elemental chromium powders is frequently foreclosed or inhibited by environmental regulation.

SUMMARY OF EXEMPLARY EMBODIMENTS OF THE INVENTION

One exemplary method discloses a process for forming a hard carbide coating onto a low chromium-containing steel article via a chemical deposition process carried out on a particulate mix, in which molybdenum in the form of a compound FeMo may be added to the particulate mix used to form the coating.

Another exemplary method discloses a process for forming a hard carbide coating onto a low chromium-containing steel article via a chemical deposition process carried out on a particulate mix, in which titanium in the form of a compound FeTi may be added to the particulate mix used to form the coating.

Yet another exemplary method discloses a process for forming a hard carbide coating onto a low chromium-containing steel article via a chemical deposition process carried out on a particulate mix, in which molybdenum in the form of a compound FeMo and titanium in the form of FeTi may be added to the particulate mix used to form the coating.

An exemplary particulate mix for coating a low chromium-containing steel substrate via a chemical deposition process includes a Group 5 metal source, a halide catalyst, and FeMo or FeTi, or a mixture of FeMo and FeTi.

An exemplary steel article such as a chain may be formed by applying a carbide coating to a low chromium-containing steel substrate, wherein the carbide coating may be formed from the exemplary particulate mix of the previous paragraph.

Other exemplary embodiments will become apparent from the detailed description provided hereinafter. It should be understood that the detailed description and specific examples, while disclosing exemplary embodiments, are intended for purposes of illustration only and are not intended to limit the scope of the invention.

BRIEF DESCRIPTION OF THE DRAWINGS

Exemplary embodiments of the invention will become more fully understood from the detailed description and the accompanying drawings, wherein.

DETAILED DESCRIPTION OF EXEMPLARY EMBODIMENTS

The following description of the embodiment(s) is merely exemplary (illustrative) in nature and is in no way intended to limit the invention, its application, or uses.

Figure 1:
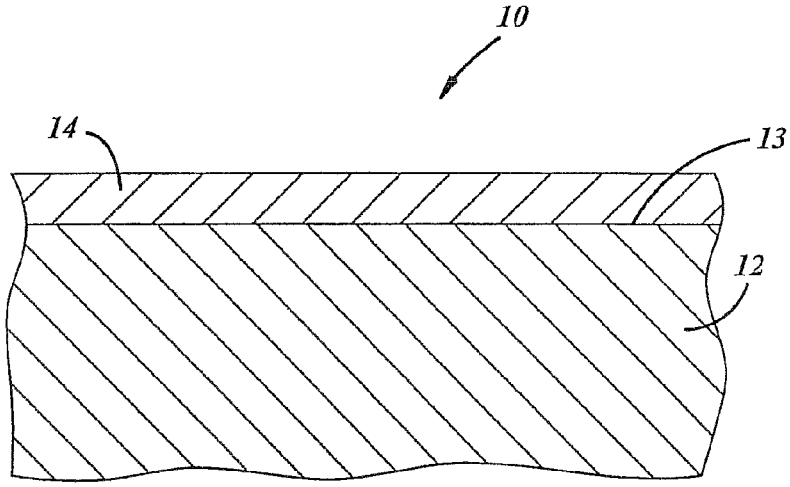
FIG. 1 is an idealized section of a pin coated with a carbide coating according to an exemplary embodiment.

Referring now to FIG. 1, one exemplary embodiment includes an article 10 having a low chromium-containing steel core 12 coated along at least one surface 13 with a carbide coating 14.

For purposes herein, a low chromium-containing steel core 12 contains less than about 1.6% chromium. The term "steel core" may be used interchangeably herein with the term "steel substrate" and merely represents wherein the article includes a low chromium-containing steel surface that is to be coated with the carbide coating 14. All percentages herein are by weight.

One exemplary embodiment of a low-chromium content steel that may be utilized in the steel core 12 is AISI 52100 (UNS-G-52986) steel with the following nominal composition: 0.98-1.1 weight percent carbon; 0.25-0.45 weight percent manganese; 1.3-1.6 weight percent chromium; 0.025 weight percent or less phosphorus; 0.025 weight percent or less sulfur; 0.15-0.35 weight percent silicon; and the balance iron.

In this exemplary illustration, the particulate mix 16 used for forming the carbide coating 14 may include a Group 5 metal source, a halide catalyst, and either ferrotitanium (FeTi) powder or ferromolybdenum (FeMo) powder (or a mixture thereof). Other substantially inert particulates, such as aluminum oxide, may also be included in the particulate mix 16, and in one embodiment may be present in amounts not greater than about 50 percent of the particulate mix 16.

A Group 5 metal source includes a Group 5 metal listed on the Periodic Table of Elements in the 18-group classification designated and recommended by the International Union of Pure and Applied Chemistry. Preferably, the Group 5 metal in the particulate mix 16, to which Vanadium and Niobium are the only members, has an atomic number no greater than 41.

A non-exclusive list of available halide catalysts that may be introduced to the particulate mix 16 includes iron chloride, ammonium chloride, niobium chloride, vanadium chloride, or mixtures thereof. The halide catalyst may be used in any effective amount, wherein one embodiment may be in an amount of about 0.6% to 3% by weight of the Group 5 metal source.

In one embodiment, the amount of FeTi or FeMo powder included in the particulate mix 16 may be between about 0.5 and about 4 weight percent of the Group 5 metal source. In other words, the weight ratio of FeTi, or FeMo, or a combination of FeTi and FeMo, to the Group 5 metal source may be in the range of about 0.02 to 0.04.

One exemplary particulate mix 16 may include ferrovanadium (FeV) powder having a particle size of 0.8 to 3 mm and about 1% of a selected halide catalyst; here iron chloride ($FeCl_3$). In addition, the particulate mix 16 may also include ferromolybdenum (FeMo) powder. The FeMo powder may be between about 0.5 and about 4 weight percent of the FeV powder. Other substantially inert particulates, such as aluminum oxide, may be included in the particulate mix 16, and in one embodiment in amounts not greater than about 50 percent of the particulate mix 16.

Figure 2:
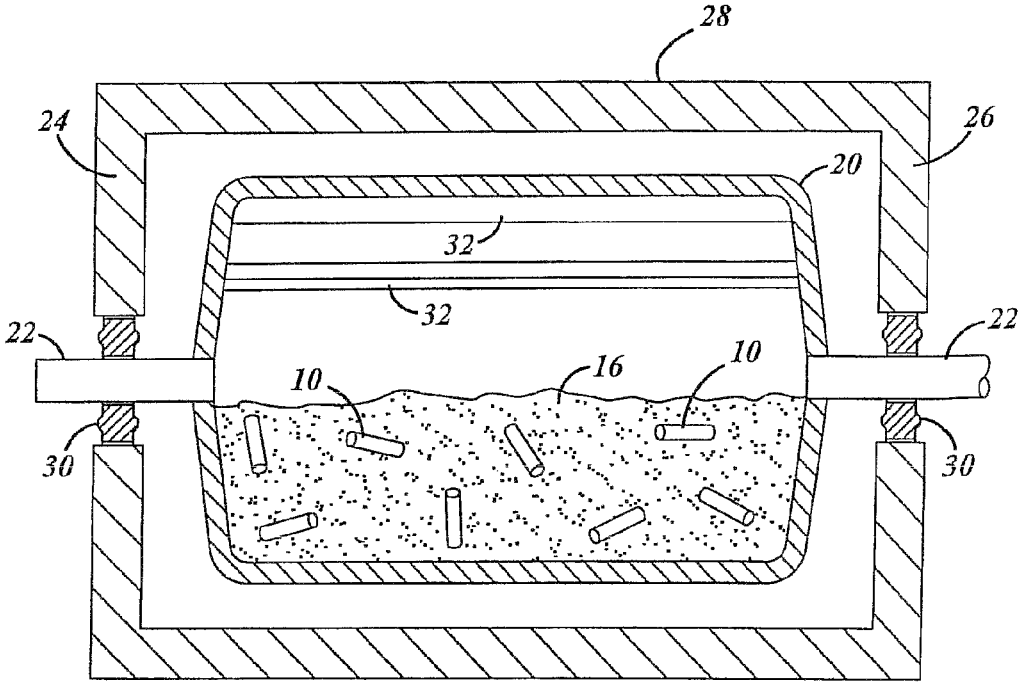
FIG. 2 is a longitudinal section view of an exemplary rotating retort containing a particulate mix for forming a coating on selected articles.

Referring now to FIG. 2, the method of the exemplary embodiments may be preferably implemented in a rotary container 20, or retort 20, having a shaft 22 held rotatably in walls 24 and 26 of furnace 28 by bushings 30 and sealed. A motor (not shown) may rotate the container 20 at a desired speed while the furnace 28 may be maintained at a temperature, in one embodiment, of about 870 to 1093 degrees Celsius (about 1600 to 2000 degrees Fahrenheit), or in another embodiment between about 927 to 1038 degrees Celsius (about 1700 to 1900 degrees Fahrenheit). Inside the container 20 may be the particulate mix 16 and at least one steel article 10, in this case steel chain pins 10, to be coated with the particulate mix 16 to form the carbide coating 14 of a desired thickness. The desired thickness may achieve a surface hardness of at least HV 2000, which may be associated with a thickness of about 10 to 20 microns. For the exemplary particulate mix 16 of the previous paragraph, the carbide coating 14 is a vanadium/carbide coating.

In one embodiment, air is withdrawn from the rotary container 20 and the process is conducted in the sealed rotary container 20 in the substantial absence of air. In another embodiment, an inert gas, preferably argon or nitrogen, is introduced to the container 20. During the heating and rotation of the rotary container 20, the source of Group 5 metal in the particulate mix 16, may be caused to dissociate, providing Group 5 metal which may be deposited at the surface of steel core 12 in the form of a halide. Carbon is drawn from the steel core 12 surface of the article 10 to displace the halide, which then reverts to the particulate mix 16 to combine with additional Group 5 metal from the source. Only a small percentage of the Group 5 metal source, estimated at 0.5 to 2% of the metal in the metal source, may consumed in the process to provide a commonly desired coating thickness of 10 to 20 microns.

The molybdenum or the titanium in the FeMo or FeTi powder added to the particulate mix 16 are carbide formers that have a high solubility in the Group 5 metal and iron and therefore may increase interface bonding of the coating formed to the core steel substrate 12.

After the article or articles 10 are treated to form a hard coating 14 as described above, the particulate mix 16 and the articles 10 may be separated, and the particulate mix 16 may be returned for re-use in the rotary container 20 to be heated again in the presence of another article or articles t10 o be coated. The particulate mix 16 need not be replenished through several iterations, but may includes the possibility of replenishing the Group 5 metal source and/or the catalyst while the bulk (at least 50%) of the particulate mix 16 in successive uses may comprise material having been used before for the purpose. Since generally less than 2% of the Group 5 metal source may be consumed in a single use, and since the halide displaced from the Group 5 metal at the surface returns to the particulate mix 16 to combine with additional Group 5 metal, the exemplary method may include the use of the same batch of particulates for at least two batches of articles 10, and additional batches as the economics of the facility may suggest. Generally at least five uses will be quite practical. Preferably, for any given use, the ratio of Group 5 metal in the Group 5 metal source to the articles will not be below 1:2 by weight, and may be preferably 1:1 to 2:1 by weight.

The article 10 including the carbide coating 14 may then be cooled and separated from the particulate mix 16. The article 10 may then be heat-treated, in a post-production step, by subjecting the coated article 10 to at least austenitizing temperature and quenched in a conventional manner to harden the core, preferably achieving a final core hardness of Rc44-56. The article 10 may then be polished in a conventional manner.

Figure 3:
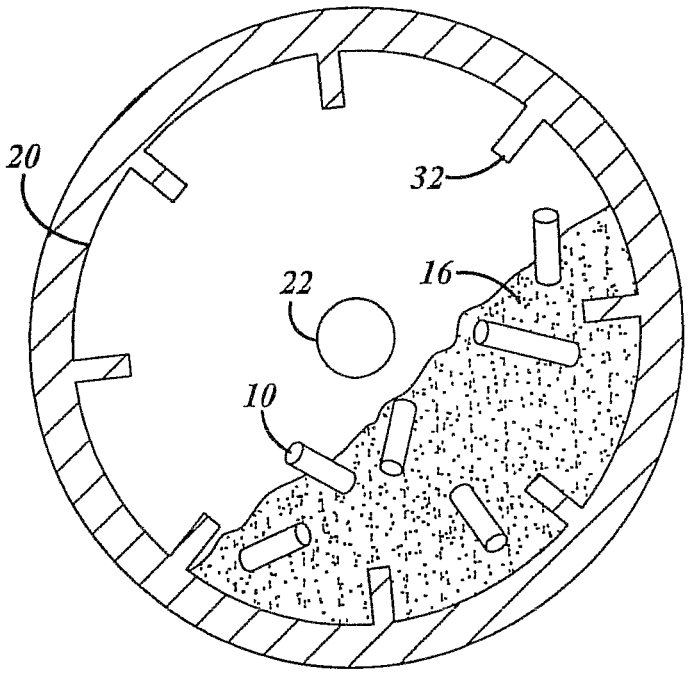
FIG. 3 is an idealized end section of the retort also showing the particulate mix and selected articles.

FIG. 3 is an end section of the container 20, illustrating how the contents may be mixed, preferably with the aid of baffles 32, during rotation of the container 20. The particulate mix 16 and the article(s) 10 to be coated may be substantially constantly contacted during the rotation of the container 20, therein causing the carbide coating 14 to be formed on the surface of the steel chain pins 10 at a desired thickness, wherein the desired thickness may be dictated primarily by the amount of time in which the article 10 is rotated within the rotary container 20. The vessel, retort, or container 20 may be rocked or otherwise agitated rather than rotated.

Figure 4:
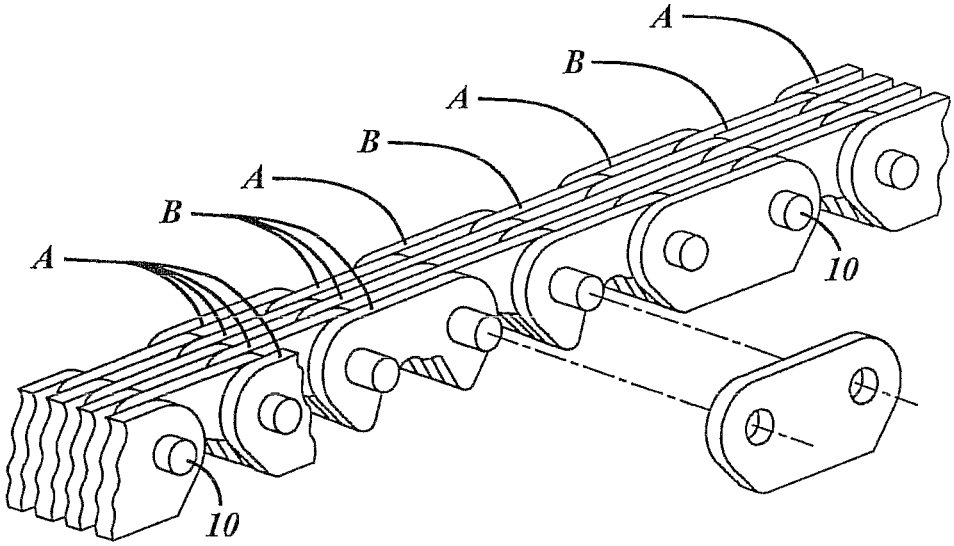
FIG. 4 shows a portion of a silent chain generally of a prior art design but including pins as from FIG. 1.

In FIG. 4, a portion of a typical silent chain is shown, comprising sets of plates A and B, each having two holes for pins 10. In this configuration, parallel sets A of four plates and parallel sets B of three plates may be shaped to accommodate sprockets or otherwise to engage a force-delivering device not shown. Some of the plates A or B may articulate on the pins 10 and others may be secured to them so as not to rotate on the pins, depending on the design of the chain. In either event, whether there is articulation or not at the plate/pin interface, significant stress and wear may be engendered at the interface of the pins and the plates.

A comparison of chain pins 10 made according to the exemplary process to more conventional pins showed that the hard coating on the pins 10 did not flake off the pin 10 when it was bent in a vise, whereas pins made by a conventional process flaked off. This is generally taken to mean that when the coating 14 of the pin 10 may be abraded, but will nevertheless adhere more tenaciously than the coating of the conventional pin. As indicated above, flaking or spalling of hard coatings can be very destructive to worn contact surfaces of chain parts.

The above description of embodiments of the invention is merely exemplary in nature and, thus, variations thereof are not to be regarded as a departure from the spirit and scope of the invention.

What is claimed is:

1. A method comprising:

providing a low chromium-containing steel core;

forming a particulate mix comprising a Group 5 metal source including a Group 5 metal, a halide catalyst, and a powder including a mixture of ferromolybdenum and ferrotitanium, wherein said Group 5 metal has an atomic number no greater than 41 and the weight ratio of said powder to said Group 5 metal in said particulate mix is between about 0.02 to 0.04; and forming a carbide coating comprising said particulate mix on at least one surface of said steel core via a chemical deposition process.

2. The method of claim 1, wherein said Group 5 metal source comprises ferrovanadium.

3. The method of claim 1, wherein forming a coating comprises:

introducing said particulate mix and said steel core to a sealed container;

heating said sealed container to a temperature of about 870 to 1093 degrees Celsius;

contacting said steel core with said particulate mix for a predetermined period of time within said sealed container to form a carbide coating on said surface of said steel core at a desired thickness.

4. The method of claim 1, wherein the chromium content of said low chromium-containing steel core does not exceed about 1.6 weight percent.

5. The method of claim 1 further comprising:

cooling said steel core containing said carbide coating;

separating said steel core containing said carbide coating from said particulate mix;

heating said steel core containing said carbide coating to at least its austenitizing temperature; and quenching said steel core containing said carbide coating, whereby said steel core containing said carbide coating has a core hardness of Rc44-56 and a surface hardness of at least HV 2000.

* * * * *